US007673678B2

(12) United States Patent
MacDougall et al.

(10) Patent No.: US 7,673,678 B2
(45) Date of Patent: Mar. 9, 2010

(54) FLOW CONTROL DEVICE WITH A PERMEABLE MEMBRANE

(75) Inventors: Thomas D. MacDougall, Sugar Land, TX (US); Nihat Ovutmen, Sugar Land, TX (US); Mark Fraker, Houston, TX (US); Qing Yao, Pearland, TX (US); Donald Ross, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 371 days.

(21) Appl. No.: 11/643,226

(22) Filed: Dec. 21, 2006

(65) Prior Publication Data

US 2007/0131434 A1 Jun. 14, 2007

Related U.S. Application Data

(63) Continuation-in-part of application No. 11/314,839, filed on Dec. 21, 2005.

(60) Provisional application No. 60/593,206, filed on Dec. 21, 2004.

(51) Int. Cl.
*E21B 43/08* (2006.01)

(52) U.S. Cl. ..... 166/228; 166/229; 166/236

(58) Field of Classification Search ..... 166/227, 166/228, 229, 230, 231, 235, 236
See application file for complete search history.

(56) References Cited

U.S. PATENT DOCUMENTS 2,837,032 A * 6/1958 Horsting, Sr. ..... 92/78
5,269,376 A 12/1993 Gadelle et al.
5,307,984 A * 5/1994 Nagaoka et al. ..... 228/189
5,355,953 A 10/1994 Shy
5,435,393 A 7/1995 Brekke
5,730,223 A 3/1998 Restarick
5,803,179 A 9/1998 Echols
5,881,809 A 3/1999 Gillespie
5,896,928 A 4/1999 Coon
5,906,238 A 5/1999 Carmody et al.
6,112,815 A 9/2000 Boe (Continued)

FOREIGN PATENT DOCUMENTS

EP 0 588 421 9/1993

(Continued)

OTHER PUBLICATIONS

C. Atkinson, et al. "Flow Performance of Horizontal Wells with Inflow Control Devices", European Journal of Applied Mathematics, vol. 15, issue 04, pp. 409-450 (Aug. 2004).

(Continued)

*Primary Examiner*—Kenneth Thompson
(74) *Attorney, Agent, or Firm*—Jeremy P. Welch; Rodney Warfford; Trop, Pruner & Hu, P.C.

(57) ABSTRACT

A system for use in a well includes plural flow control devices to control fluid flow in respective zones of the well, where each of at least some of the flow control devices includes a membrane having a permeable material to provide a flow restriction. The membranes of the at least some flow control devices have different permeabilities to provide corresponding different flow restrictions.

22 Claims, 2 Drawing Sheets

U.S. PATENT DOCUMENTS

| | | | | |
|---|---|---|---|---|
| 6,112,817 | A | 9/2000 | Voll | |
| 6,276,458 | B1 | 8/2001 | Malone et al. | |
| 6,343,651 | B1 | 2/2002 | Bixenman | |
| 6,371,210 | B1 | 4/2002 | Bode | |
| 6,505,682 | B2 * | 1/2003 | Brockman | 166/250.15 |
| 6,533,038 | B2 | 3/2003 | Venning et al. | |
| 6,622,794 | B2 | 9/2003 | Zisk, Jr. | |
| 6,644,412 | B2 | 11/2003 | Bode | |
| 6,672,385 | B2 * | 1/2004 | Kilaas et al. | 166/250.01 |
| 6,745,843 | B2 | 6/2004 | Johnson | |
| 6,786,285 | B2 | 9/2004 | Johnson et al. | |
| 6,851,560 | B2 | 2/2005 | Reig | |
| 6,857,475 | B2 | 2/2005 | Johnson | |
| 6,857,575 | B2 | 2/2005 | Mathias et al. | |
| 6,883,613 | B2 | 4/2005 | Bode | |
| 6,899,176 | B2 | 5/2005 | Hailey, Jr. et al. | |
| 7,407,007 | B2 * | 8/2008 | Tibbles | 166/278 |
| 7,413,022 | B2 * | 8/2008 | Broome et al. | 166/386 |
| 2002/0075110 | A1 | 6/2002 | Shimizu | |
| 2003/0023185 | A1 | 1/2003 | Mertelmeier | |
| 2003/0066651 | A1 * | 4/2003 | Johnson | 166/369 |
| 2004/0018839 | A1 | 1/2004 | Andric | |
| 2005/0126776 | A1 * | 6/2005 | Russell | 166/229 |
| 2005/0173130 | A1 * | 8/2005 | Richard | 166/384 |
| 2006/0185849 | A1 * | 8/2006 | Edwards et al. | 166/296 |
| 2009/0008092 | A1 * | 1/2009 | Haeberle et al. | 166/278 |

FOREIGN PATENT DOCUMENTS

| | | |
|---|---|---|
| WO | WO 02/075110 | 9/2002 |
| WO | WO 03/023185 | 3/2003 |
| WO | WO 2004/018839 | 3/2004 |
| WO | WO 2004/113671 | 12/2004 |

OTHER PUBLICATIONS

"EQUALIZER™ Production Enhancement System", Baker Oil Tools, Baker Hughes Inc., Pub. No. BOT-04-7761 4M (Jun. 2005).

"Application Answers: Combating Coning by Creating Even Flow Distribution in Horizontal Sand-Control Completions", Weatherford International Ltd. (2005).

Ben J. Dikken, "Pressure Drop in Horizontal Wells and Its Effect on Production Performance", SPE 19824, pp. 1426-1433, pp. 569-574, Society of Petroleum Engineers (Nov. 1990).

M.J. Landman, et al., "Optimization of Perforation Distribution for Horizontal Wells", SPE 23005, pp. 567-576, Society of Petroleum Engineers (1991).

A.N. Folefac, et al., "Effect of Pressure Drop Along Horizontal Wellbores on Well Performance", SPE 23094, pp. 549-560, Society of Petroleum Engineers (1991).

B.P. Marrett, et al., "Optimal Perforation Design for Horizontal Wells in Reservoirs with Boundaries", SPE 25366, pp. 397-406, Society of Petroleum Engineers (1993).

Kristian Brekke, et al., "A New Modular Approach to Comprehensive Simulation of Horizontal Wells", SPE 26518, pp. 109-123, Society of Petroleum Engineers (1993).

Fikri J. Kuchuk, et al., "Performance Evaluation of Horizontal Wells", SPE 39749, pp. 231-243, Society of Petroleum Engineers (1998).

Hong Yuan, et al., "Effect of Completion Geometry and Phasing on Single-Phase Liquid Flow Behavior in Horizontal Wells", SPE 48937, pp. 93-104, Society of Petroleum Engineers (1998).

Yula Tang, et al., "Performance of Horizontal Wells Completed with Slotted Liners and Perforations", SPE 65516, pp. 1-15, Society of Petroleum Engineers/PS-CIM International Conference on Horizontal Well Technology (1991).

Terje Moen, et al., "A New Sand Screen Concept. No Longer the Weakest Link of the Completion String", SPE 68937, pp. 1-10, Society of Petroleum Engineers (2001).

Jody R. Augustine, "An Investigation of the Economic Benefit of Inflow Control Devices on Horizontal Well Completions Using a Reservoir-Wellbore Coupled Model", SPE 78293, pp. 1-10, Society of Petroleum Engineers (2002).

D.S. Qudaihy, et al., "New-Technology Application to Extend the life of Horizontal Wells by Creating Uniform-Flow-Profiles: Production Completion System: Case Study", SPE/IADC 85332, pp. 1-5, Society of Petroleum Engineers/International Association of Drilling Contractors (2003).

K.H. Henriksen, et al., "Integration of New Open Hole Zonal Isolation Technology Contributes to Improved Reserve Recovery and Revision in Industry Best Practices", SPE 97614, pp. 1-6, Society of Petroleum Engineers (2005).

J.C. Moreno, et al., "Optimized Workflow for Designing Complex Wells", SPE 99999, pp. 1-8, Society of Petroleum Engineers (2006).

Sada D. Joshi, *Horizontal Well Technology*, Chapter 10, "Pressure Drop Through a Horizontal Well", pp. 379-382, 388-396, 404-407, 412-414, PennWell Books, PennWell Publishing Co., Tulsa, OK (1991).

ResFlow,Reslink, http://www.reslink.com/products3.html (2003).

ResFlow: Well Production Management System, Reslink (2005).

Equalizer Production Management System, Baker-Hughes, Baker Oil Tools (nd).

Cameron White, et al., "Controlling Flow in Horizontal Wells", World Oil, pp. 73-80 (Nov. 1991).

* cited by examiner

FLOW CONTROL DEVICE WITH A PERMEABLE MEMBRANE

CROSS-REFERENCE TO RELATED APPLICATION

This is a continuation-in-part of U.S. Ser. No. 11/314,839, filed Dec. 21, 2005, which claims the benefit under 35 U.S.C. §119(e) of U.S. Provisional Application Ser. No. 60/593,206, filed Dec. 21, 2004, both hereby incorporated by reference.

TECHNICAL FIELD

The invention relates generally to flow control devices that include permeable membranes.

BACKGROUND

A well (e.g., a vertical well, near-vertical well, deviated well, horizontal well, or multi-lateral well) can pass through various hydrocarbon bearing reservoirs or may extend through a single reservoir for a relatively long distance. A technique to increase the production of the well is to perforate the well in a number of different zones, either in the same hydrocarbon bearing reservoir or in different hydrocarbon bearing reservoirs.

An issue associated with producing from a well in multiple zones relates to the control of the flow of fluids into the well. In a well producing from a number of separate zones, in which one zone has a higher pressure than another zone, the higher pressure zone may produce into the lower pressure zone rather than to the surface. Similarly, in a horizontal well that extends through a single reservoir, zones near the "heel" of the well (closest to the vertical or near vertical part of the well) may begin to produce unwanted water or gas (referred to as water or gas coning) before those zones near the "toe" of the well (furthest away from the vertical or near vertical departure point). Production of unwanted water or gas in any one of these zones may require special interventions to be performed to stop production of the unwanted water or gas.

In other scenarios, certain zones of the well may have excessive drawdown pressures, which can lead to early erosion of the flow control devices or other problems.

To address coning effects or other issues noted above, flow control devices are placed into the well. There are various different types of flow control devices that have conventionally been used to equalize flow rates (or pressure drops) in different zones of a well. However, conventional flow control devices generally suffer from lack of flexibility and/or are relatively complex in design.

SUMMARY

In general, according to an embodiment, a system for use in a well includes plural flow control devices to control fluid flow in respective zones of the well. Each of at least some of the flow control devices includes a membrane including a permeable material to provide fluid flow control. The membranes of the at least some flow control devices provide different permeabilities.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

Figure 1:
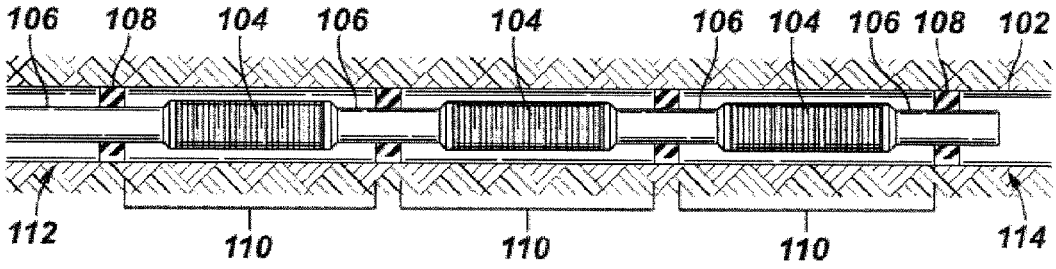
FIG. 1 illustrates an example arrangement of a completion system that incorporates flow control devices according to some embodiments.

FIG. 1 illustrates an example completion system installed in a horizontal or substantially horizontal wellbore 102 where the completion system includes multiple flow control devices 104 in accordance with some embodiments. Although the wellbore 102 is depicted as being a horizontal or substantially horizontal wellbore, the flow control devices according to some embodiments can be used in vertical or deviated wellbores in other implementations. The flow control devices 104 are connected to a tubing or pipe 106 (more generally referred to as a "flow conduit") that can extend to the earth surface or to some other location in the wellbore 102. Also, sealing elements 108 (e.g., packers) are provided to define different zones 110 in the wellbore 102.

The different zones 110 correspond to different fluid flow zones, where fluid flow in each zone 110 is controlled by a respective flow control device 104.

In a production context, fluid flows from a surrounding reservoir (or reservoirs) into the wellbore 102, with the flow control devices 104 controlling the flow of such incoming fluids (which can be hydrocarbons) into the pipe 106. On the other hand, in the injection context, the flow control devices 104 control injection of fluid from inside the pipe 106 out towards the surrounding formation.

An issue associated with producing or injecting fluids in a well having multiple zones, such as the wellbore 102 depicted in FIG. 1, is that there can be unequal pressure drops in the different zones. Pressure drop refers to local drawdown pressure caused by friction pressure due to flow of fluids (injection fluids or production fluids) in a flow conduit (production or injection conduit). The horizontal or substantially horizontal wellbore 102 has a heel 112 and a toe 114. During production, the pressure drop at the heel 112 tends to be larger than the pressure drop at the toe 114, which can result in a greater flow rate at the heel 112 than at the toe 114. Consequently, hydrocarbons in the reservoir portion proximate the heel 112 will deplete at a faster rate than hydrocarbons in the reservoir portion proximate the toe 114. This can result in production of unwanted water or gas into the wellbore zone proximate the heel 112 (an effect referred to as water or gas coning).

To control the production profile (by controlling the pressure drops and flow rates into the different zones 110 of the wellbore 102), the flow control devices 104 are provided. Note that water or gas coning is just one of the adverse effects that result from different pressure drops in different zones. Other adverse effects include excessive erosion of equipment in zones with larger pressure drops, the possibility of cave-in in a zone having a large pressure drop, and others.

Although reference is made to production of fluids, it is noted that flow control is also desirable in the injection context.

Each flow control device 104 in accordance with some embodiments has a membrane including a permeable material (this type of membrane is referred to as a "permeable membrane") through which fluid flows between the inside and outside of the flow control device 104. The permeable membrane provides pressure drop and flow rate control between the inside and outside of the flow control device 104. To provide selective pressure drop and flow rate control through each flow control device 104, the permeable membranes associated with corresponding flow control devices in the plural zones are selected to provide different flow restrictions. Flow restrictions through the permeable membranes are controlled by selecting permeabilities for the permeable membranes such that a desired production profile or injection profile (more generally a "flow profile") can be achieved along the wellbore 102. Effectively, the permeable membranes associated with different flow control devices have variable permeabilities across the different zones to achieve corresponding target flow restrictions. The permeability of each permeable membrane can be set at the factory or other assembly location.

Figure 2:
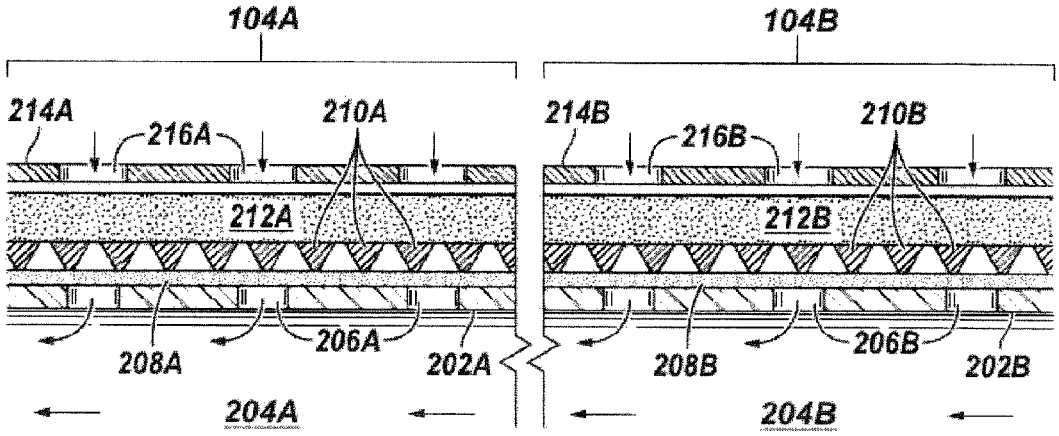
FIG. 2 illustrates flow control devices according to an embodiment that each has a permeable membrane to provide fluid flow control, according to an embodiment.

FIG. 2 shows portions of two flow control devices 104A, 104B, where flow control device 104A is positioned closer to the heel 112 of the wellbore 102 than the flow control device 104B, while the flow control device 104B is positioned closer to the toe 114 of the wellbore 102 than the flow control device 104A. Each flow control device 104A, 104B includes a respective perforated base pipe 202A, 202B that includes corresponding openings 206A, 206B. In the example of FIG. 2, fluid flows from outside each flow control device into the inner bore 204A, 204B of the respective flow control device 104A, 104B for production of fluids from surrounding reservoir(s) into the tubing string that includes the flow control devices 104A, 104B. In the injection context, fluid flows in the reverse direction (from inside the inner bore 204A, 204B of each flow control device out toward the well annulus region outside each flow control device 104A, 104B).

Each flow control device 104A, 104B further includes a respective permeable membrane 208A, 208B that has a permeable material. The flow control devices 104A, 104B have permeable membranes 208A, 208B selected to have different permeabilities to provide variable flow restrictions along the length of the tubing string that includes the flow control devices 104A, 104B. The permeable membrane 208A of the flow control device 104A has a lower permeability than the permeable membrane 208B of the flow control device 104B. A membrane having a lower permeability provides a greater restriction to fluid flow, and thus increases the pressure drop for fluid flow across the permeable membrane.

FIG. 2 also shows a screen 210A, 210B provided around the respective permeable membrane 208A, 208B of a respective flow control device 104A, 104B. Each screen 210A, 210B can be a wire-wrapped screen or some other type of screen. The primary purpose of the screens 210A, 210B is to provide sand control (or control of other particulates) such that sand or other particulates are not produced into the tubing string during production.

As depicted in FIG. 2, gravel layers 212A, 212B are provided around corresponding screens 210A, 210B. The gravel layers 212A, 212B are also provided for sand control. Also, in the example implementation depicted in FIG. 2, each flow control device 104A, 104B includes a respective perforated outer shroud 214A, 214B, where each perforated outer shroud 214A, 214B includes openings 216A, 216B, respectively, to allow communication of fluid between the inside and outside of the respective flow control device 104A, 104B.

In alternative embodiments, the screens 210A, 210B, gravel layers 212A, 212B, and outer shrouds 214A, 214B can be omitted.

Examples of permeable membranes 208A, 208B that can be used in the flow control devices according to some embodiments include meshes (formed by an arrangement of interlocking or woven links whose permeability can be adjusted based on adjusting a number of openings per defined area), porous layers (having pores whose density can be varied to provide different permeabilities), and sintered materials (whose permeabilities are controlled by how tightly packed the sintered materials are).

In some embodiments, each permeable membrane 208A, 208B can also optionally include swellable particles that expand in the presence of water (or some other activating fluid). Swelling of the swellable particles causes the membrane to close any interstitial volumes; consequently, swelling of the swellable particles blocks intrusion of any undesirable fluids from flowing through the flow control device. In one example implementation, the swellable material in the permeable membrane shuts off the flow control device in the presence of water, which can occur as a result of water coning (production of unwanted water).

Examples of materials that swell in the presence of an activating fluid include the following: BACEL hard foam or a hydrogel polymer. In one implementation, the swellable material is not substantially affected by exposure to hydrocarbon fluids, so the material can be located in specific regions (such as zones near the heel of the wellbore) susceptible to detrimental incursion of water migration that can interfere with production of hydrocarbon fluids.

Figure 3:
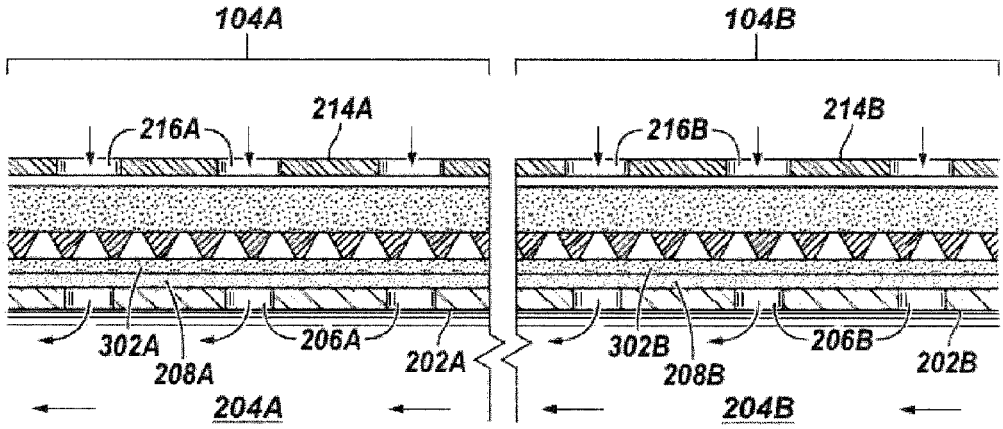
FIG. 3 illustrates flow control devices according to another embodiment that each has a permeable membrane with swellable particles that swell in response to activating fluid.

In an alternative embodiment, as depicted in FIG. 3, each flow control device can be provided with two permeable membranes, including a first permeable membrane 208A, 208B (as discussed above), and a second permeable membrane 302A, 302B.

Each second permeable membrane 302A, 302B in each flow control device includes swellable particles, as discussed above, where the swellable particles expand in the presence of an activating fluid, such as water. Thus, in any zone in which an unwanted fluid, such as water, is present, the second membrane 304 acts as a shut-off valve to prevent further intrusion of water into the production conduit.

Figure 4A:
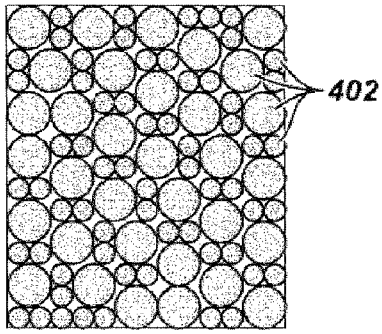
FIGS. 4A-4B illustrate a permeable membrane with swellable particles in two different states.

FIG. 4A illustrates the second permeable membrane 304 having swellable particles 402 that swell or expand when exposed to a specific activating fluid. Additionally, the membrane can be a mixture of swellable particles and conventional (non-swelling) particles. In this embodiment, the swellable particles 402 expand and swell against each other and against the conventional particles to reduce or eliminate the interstitial volumes between particles. In another embodiment, the particles of the membrane are substantially all swellable particles 402 that expand when exposed to an activating fluid. In this latter embodiment, all particles exposed to water swell to reduce or eliminate the interstitial volumes between particles.

Figure 4B:
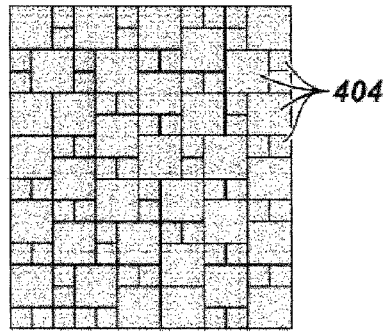

In the embodiment of FIG. 4A, for example, the particles are substantially all swellable particles 402 that have been exposed to water, or another swell inducing substance, which has caused the particles to expand into the interstitial volumes, as depicted as swollen particles 404 in FIG. 4B. Accordingly, the membrane has one permeability when flowing hydrocarbon fluids and another permeability after activation in the presence of specific substances that cause particles 402 to transition from a contracted state to an expanded state.

Once expansion has occurred, further fluid flow through that area of the membrane is prevented or substantially reduced.

Instead of providing two membranes 208 and 302 (one membrane formed of a swellable material and another membrane formed of a non-swellable material) in each flow control device, each flow control device can alternatively include a single membrane that includes both swellable and non-swellable materials, with the permeability of the single membrane set to a target permeability for a corresponding zone. In other implementations, swellable particles are not included in the permeable membrane.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A system for use in a well, comprising:

plural flow control devices to control fluid flow in respective zones of the well, wherein each of at least some of the flow control devices includes a first membrane having a permeable material to provide a flow restriction, and wherein the first membranes of the at least some flow control devices have different permeabilities to provide corresponding different flow restrictions, wherein at least one of the at least some flow control devices includes an additional membrane in addition to the first membrane, wherein the additional membrane has swellable particles that swell in presence of an activating fluid to shut off further fluid flow.

2. The system of claim 1, wherein the permeable materials of the first membranes of the at least some flow control devices comprise meshes.

3. The system of claim 1, wherein the permeable materials of the first membranes of the at least some flow control devices comprise porous materials.

4. The system of claim 1, wherein the permeable materials of the first membranes of the at least some flow control devices comprise packed sintered materials.

5. The system of claim 1, wherein the swellable particles swell in the presence of water.

6. The system of claim 1, wherein each of the at least some flow control devices further includes a screen around the first membrane.

7. The system of claim 6, wherein the screen comprises a sand screen.

8. The system of claim 6, wherein each of the at least some flow control devices further includes a perforated base pipe, wherein each first membrane is positioned between a corresponding base pipe and screen.

9. The system of claim 1, wherein in the at least one of the at least some flow control devices, the first membrane is adjacent the additional membrane such that fluid flow occurs through both the first membrane and the additional membrane.

10. The system of claim 1, wherein in the at least one of the at least some flow control devices, the first membrane is in contact with the additional membrane.

11. A method for use in a well, comprising:

providing plural flow control devices to control flow rates in respective zones of the well, wherein each of at least some of the flow control devices includes a permeable membrane to provide a flow restriction;

setting permeabilities of the permeable membranes of the at least some flow control devices to have different permeabilities to provide corresponding different flow restrictions along a length of the well; and providing an additional membrane in at least one of the at least some flow control devices, where the additional membrane contains swellable particles that swell in presence of activating fluid.

12. The method of claim 11, wherein providing the permeable membranes to have different permeabilities define a flow profile across multiple zones of the well.

13. The method of claim 12, wherein defining the flow profile comprises defining one of a production profile and an injection profile.

14. The method of claim 11, wherein setting the permeabilities of the permeable membranes comprises setting the permeabilities of permeable membranes implemented with at least one of meshes, porous materials, and packed sintered materials.

15. The method of claim 11, wherein setting the permeabilities of the permeable membranes is performed at an assembly location.

16. The method of claim 11, further comprising providing sand control equipment as part of the flow control devices.

17. The method of claim 16, wherein providing the sand control equipment comprises providing sand screens in corresponding flow control devices.

18. The method of claim 11, wherein in the at least one of the at least some flow control devices, the first membrane is adjacent the additional membrane such that fluid flow occurs through both the first membrane and the additional membrane.

19. The method of claim 11, wherein in the at least one of the at least some flow control devices, the first membrane is in contact with the additional membrane.

20. An apparatus for use in a well, comprising:

plural permeable membranes for deployment in plural zones of a well to define a flow profile along the plural zones of the well, wherein at least two of the permeable membranes have different permeabilities; and plural swellable membranes provided adjacent corresponding permeable membranes, wherein each of the swellable membranes contains swellable particles that swell in presence of an activating fluid.

21. The apparatus of claim 20, wherein each of the permeable membranes comprises at least one of a mesh, a porous material, and a packed sintered material.

22. The apparatus of claim 20, wherein each of the permeable membranes is in contact with a respective one of the swellable membranes.

* * * * *